US011398197B2

(12) United States Patent
Crounse

(10) Patent No.: US 11,398,197 B2
(45) **Date of Patent: *Jul. 26, 2022**

(54) METHODS AND CIRCUITRY FOR DRIVING DISPLAY DEVICES

(71) Applicant: E Ink Corporation, Billerica, MA (US)

(72) Inventor: Kenneth R. Crounse, Somerville, MA (US)

(73) Assignee: E Ink Corporation, Billerica, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/221,134

(22) Filed: Apr. 2, 2021

(65) Prior Publication Data

US 2021/0225295 A1 Jul. 22, 2021

Related U.S. Application Data

(63) Continuation of application No. 15/165,795, filed on May 26, 2016, now Pat. No. 10,997,930.

(60) Provisional application No. 62/167,065, filed on May 27, 2015.

(51) Int. Cl.
*G09G 3/34* (2006.01)

(52) U.S. Cl.
CPC ..... *G09G 3/344* (2013.01); *G09G 2300/0842* (2013.01); *G09G 2310/0251* (2013.01); *G09G 2310/063* (2013.01)

(58) Field of Classification Search
CPC ..... G09G 3/344; G09G 2300/0842; G09G 2310/0251; G09G 2310/063
See application file for complete search history.

(56) References Cited

U.S. PATENT DOCUMENTS

| | | | |
|---|---|---|---|
| 5,930,026 | A | 7/1999 | Jacobson et al. |
| 6,124,851 | A | 9/2000 | Jacobson |
| 6,130,773 | A | 10/2000 | Jacobson et al. |
| 6,137,467 | A | 10/2000 | Sheridon et al. |
| 6,144,348 | A | 11/2000 | Kanazawa et al. |
| 6,177,921 | B1 | 1/2001 | Comiskey et al. |
| 6,232,950 | B1 | 5/2001 | Albert et al. |
| 6,241,921 | B1 | 6/2001 | Jacobson et al. |

(Continued)

FOREIGN PATENT DOCUMENTS

| | | | |
|---|---|---|---|
| EP | 1099207 | B1 | 5/2001 |
| EP | 1145072 | B1 | 10/2001 |
| WO | 2000038000 | A1 | 6/2000 |

OTHER PUBLICATIONS

European Patent Office; PCT/US2016/034630; International Search Report and Written Opinion; dated Oct. 24, 2016.

*Primary Examiner* — Stephen G Sherman
(74) *Attorney, Agent, or Firm* — Jason P. Colangelo

(57) ABSTRACT

A display device is operated by using several iterations of a scan phase followed by a global drive phase. In the scan phase, the state of each pixel in the display device is set to either "enabled" or "disabled", during which time a global drive generator is inactive. Then, in the global drive phase, a global drive signal is sent to the display device. Only the subset of enabled pixels is affected by the global drive signal, which causes the enabled pixels to perform a transition to a desired display state. The sequence of the scan phase followed by the global drive phase is then repeated up to the number of unique transitions required to update the display device.

18 Claims, 8 Drawing Sheets

(56) References Cited

U.S. PATENT DOCUMENTS 6,252,564 B1 6/2001 Albert et al.
6,262,703 B1 7/2001 Perner
6,312,304 B1 11/2001 Duthaler et al.
6,312,971 B1 11/2001 Amundson et al.
6,376,828 B1 4/2002 Comiskey
6,392,786 B1 5/2002 Albert
6,413,790 B1 7/2002 Duthaler et al.
6,422,687 B1 7/2002 Jacobson
6,445,374 B2 9/2002 Albert et al.
6,445,489 B1 9/2002 Jacobson et al.
6,480,182 B2 11/2002 Turner et al.
6,498,114 B1 12/2002 Amundson et al.
6,504,524 B1 1/2003 Gates et al.
6,506,438 B2 1/2003 Duthaler et al.
6,512,354 B2 1/2003 Jacobson et al.
6,518,949 B2 2/2003 Drzaic
6,521,489 B2 2/2003 Duthaler et al.
6,531,997 B1 3/2003 Gates et al.
6,535,197 B1 3/2003 Comiskey et al.
6,545,291 B1 4/2003 Amundson et al.
6,639,578 B1 10/2003 Comiskey et al.
6,657,772 B2 12/2003 Loxley
6,664,944 B1 12/2003 Albert et al.
D485,294 S 1/2004 Albert
6,680,725 B1 1/2004 Jacobson
6,683,333 B2 1/2004 Kazlas et al.
6,724,519 B1 4/2004 Comiskey et al.
6,750,473 B2 6/2004 Amundson et al.
6,753,999 B2 6/2004 Zehner et al.
6,816,147 B2 11/2004 Albert
6,819,471 B2 11/2004 Amundson et al.
6,825,068 B2 11/2004 Denis et al.
6,825,970 B2 11/2004 Goenaga et al.
6,831,769 B2 12/2004 Holman et al.
6,842,167 B2 1/2005 Albert et al.
6,842,279 B2 1/2005 Amundson
6,842,657 B1 1/2005 Drzaic et al.
6,865,010 B2 3/2005 Duthaler et al.
6,900,851 B2 5/2005 Morrison et al.
6,922,276 B2 7/2005 Zhang et al.
6,950,220 B2 9/2005 Abramson et al.
6,967,640 B2 11/2005 Albert et al.
6,980,196 B1 12/2005 Turner et al.
6,982,178 B2 1/2006 LeCain et al.
6,995,550 B2 2/2006 Jacobson et al.
7,002,728 B2 2/2006 Pullen et al.
7,012,600 B2 3/2006 Zehner et al.
7,012,735 B2 3/2006 Honeyman
7,023,420 B2 4/2006 Comiskey et al.
7,030,412 B1 4/2006 Drzaic et al.
7,034,783 B2 4/2006 Gates et al.
7,075,502 B1 7/2006 Drzaic et al.
7,075,703 B2 7/2006 O'Neil et al.
7,106,296 B1 9/2006 Jacobson
7,110,163 B2 9/2006 Webber et al.
7,116,318 B2 10/2006 Amundson et al.
7,116,466 B2 10/2006 Whitesides et al.
7,119,772 B2 10/2006 Amundson et al.
7,148,128 B2 12/2006 Jacobson
7,167,155 B1 1/2007 Albert et al.
7,167,169 B2 1/2007 Libsch et al.
7,173,752 B2 2/2007 Doshi et al.
7,176,880 B2 2/2007 Amundson et al.
7,190,008 B2 3/2007 Amundson et al.
7,193,625 B2 3/2007 Danner et al.
7,202,847 B2 4/2007 Gates
7,206,119 B2 4/2007 Honeyman et al.
7,223,672 B2 5/2007 Kazlas et al.
7,230,751 B2 6/2007 Whitesides et al.
7,256,766 B2 8/2007 Albert et al.
7,259,744 B2 8/2007 Arango et al.
7,280,094 B2 10/2007 Albert
7,304,787 B2 12/2007 Whitesides et al.
7,312,784 B2 12/2007 Baucom et al.
7,312,794 B2 12/2007 Zehner et al.
7,319,465 B2 1/2008 Mikami et al.
7,327,511 B2 2/2008 Whitesides et al.
7,349,148 B2 3/2008 Doshi et al.
7,352,353 B2 4/2008 Albert et al.
7,365,394 B2 4/2008 Denis et al.
7,365,733 B2 4/2008 Duthaler et al.
7,382,363 B2 6/2008 Albert et al.
7,388,572 B2 6/2008 Duthaler et al.
7,411,719 B2 8/2008 Paolini, Jr. et al.
7,420,549 B2 9/2008 Jacobson et al.
7,442,587 B2 10/2008 Amundson et al.
7,453,445 B2 11/2008 Amundson
7,492,339 B2 2/2009 Amundson
7,492,497 B2 2/2009 Paolini, Jr. et al.
7,528,822 B2 5/2009 Amundson et al.
7,535,624 B2 5/2009 Amundson et al.
7,545,358 B2 6/2009 Gates et al.
7,551,346 B2 6/2009 Fazel et al.
7,554,712 B2 6/2009 Patry et al.
7,583,251 B2 9/2009 Arango et al.
7,583,427 B2 9/2009 Danner et al.
7,598,173 B2 10/2009 Ritenour et al.
7,602,374 B2 10/2009 Zehner et al.
7,605,799 B2 10/2009 Amundson et al.
7,612,760 B2 11/2009 Kawai
7,636,191 B2 12/2009 Duthaler et al.
7,649,674 B2 1/2010 Danner et al.
7,667,886 B2 2/2010 Danner et al.
7,672,040 B2 3/2010 Sohn et al.
7,679,599 B2 3/2010 Kawai
7,679,814 B2 3/2010 Paolini, Jr. et al.
7,688,297 B2 3/2010 Zehner et al.
7,688,497 B2 3/2010 Danner et al.
7,729,039 B2 6/2010 LeCain et al.
7,733,311 B2 6/2010 Amundson et al.
7,733,335 B2 6/2010 Zehner et al.
7,785,988 B2 8/2010 Amundson et al.
7,787,169 B2 8/2010 Abramson et al.
7,839,564 B2 11/2010 Whitesides et al.
7,843,626 B2 11/2010 Amundson et al.
7,859,637 B2 12/2010 Amundson et al.
7,893,435 B2 2/2011 Kazlas et al.
7,898,717 B2 3/2011 Patry et al.
7,911,414 B1 3/2011 Wedding et al.
7,952,557 B2 5/2011 Amundson
7,956,841 B2 6/2011 Albert et al.
7,957,053 B2 6/2011 Honeyman et al.
7,986,450 B2 7/2011 Cao et al.
7,999,787 B2 8/2011 Amundson et al.
8,009,344 B2 8/2011 Danner et al.
8,009,348 B2 8/2011 Zehner et al.
8,027,081 B2 9/2011 Danner et al.
8,049,947 B2 11/2011 Danner et al.
8,077,141 B2 12/2011 Duthaler et al.
8,089,453 B2 1/2012 Comiskey et al.
8,125,501 B2 2/2012 Amundson et al.
8,139,050 B2 3/2012 Jacobson et al.
8,174,490 B2 5/2012 Whitesides et al.
8,208,193 B2 6/2012 Patry et al.
8,289,250 B2 10/2012 Zehner et al.
8,300,006 B2 10/2012 Zhou et al.
8,305,341 B2 11/2012 Arango et al.
8,314,784 B2 11/2012 Ohkami et al.
8,319,759 B2 11/2012 Jacobson et al.
8,373,211 B2 2/2013 Amundson et al.
8,373,649 B2 2/2013 Low et al.
8,384,658 B2 2/2013 Albert et al.
8,389,381 B2 3/2013 Amundson et al.
8,498,042 B2 7/2013 Danner et al.
8,558,783 B2 10/2013 Wilcox et al.
8,558,785 B2 10/2013 Zehner et al.
8,593,396 B2 11/2013 Amundson et al.
8,610,988 B2 12/2013 Zehner et al.
8,728,266 B2 5/2014 Danner et al.
8,754,859 B2 6/2014 Gates et al.
8,830,560 B2 9/2014 Danner et al.
8,891,155 B2 11/2014 Danner et al.
8,928,562 B2 1/2015 Gates et al.
8,969,886 B2 3/2015 Amundson

(56) References Cited

U.S. PATENT DOCUMENTS

| | | | |
|---|---|---|---|
| 9,087,486 | B2 | 7/2015 | Gandhi et al. |
| 9,152,003 | B2 | 10/2015 | Danner et al. |
| 9,152,004 | B2 | 10/2015 | Paolini, Jr. et al. |
| 9,230,492 | B2 | 1/2016 | Harrington et al. |
| 9,269,311 | B2 | 2/2016 | Amundson |
| 9,310,661 | B2 | 4/2016 | Wu et al. |
| 9,412,314 | B2 | 8/2016 | Amundson et al. |
| 9,419,024 | B2 | 8/2016 | Amundson et al. |
| 9,495,918 | B2 | 11/2016 | Harrington et al. |
| 9,513,743 | B2 | 12/2016 | Sjodin et al. |
| 9,529,240 | B2 | 12/2016 | Paolini, Jr. et al. |
| 9,542,895 | B2 | 1/2017 | Gates et al. |
| 9,564,088 | B2 | 2/2017 | Wilcox et al. |
| 9,612,502 | B2 | 4/2017 | Danner et al. |
| 9,620,048 | B2 | 4/2017 | Sim et al. |
| 9,620,066 | B2 | 4/2017 | Bishop |
| 9,671,635 | B2 | 6/2017 | Paolini, Jr. |
| 9,672,766 | B2 | 6/2017 | Sjodin |
| 9,721,495 | B2 | 8/2017 | Harrington et al. |
| 9,778,500 | B2 | 10/2017 | Gates et al. |
| 9,966,018 | B2 | 5/2018 | Gates et al. |
| 10,037,735 | B2 | 7/2018 | Amundson |
| 10,048,563 | B2 | 8/2018 | Paolini, Jr. et al. |
| 10,048,564 | B2 | 8/2018 | Paolini, Jr. et al. |
| 10,190,743 | B2 | 1/2019 | Hertel et al. |
| 10,319,313 | B2 | 6/2019 | Harris et al. |
| 10,372,008 | B2 | 8/2019 | Telfer et al. |
| 10,446,585 | B2 | 10/2019 | Harris et al. |
| 10,672,350 | B2 | 6/2020 | Amundson et al. |
| 10,997,930 | B2 * | 5/2021 | Crounse ..... G09G 3/344 |
| 2002/0060321 | A1 | 5/2002 | Kazlas et al. |
| 2003/0102858 | A1 | 6/2003 | Jacobson et al. |
| 2004/0105036 | A1 | 6/2004 | Danner et al. |
| 2005/0122306 | A1 | 6/2005 | Wilcox et al. |
| 2005/0122563 | A1 | 6/2005 | Honeyman et al. |
| 2005/0174341 | A1 | 8/2005 | Johnson et al. |
| 2005/0253777 | A1 | 11/2005 | Zehner et al. |
| 2007/0052757 | A1 | 3/2007 | Jacobson |
| 2007/0091418 | A1 | 4/2007 | Danner et al. |
| 2007/0103427 | A1 | 5/2007 | Zhou et al. |
| 2008/0024429 | A1 | 1/2008 | Zehner |
| 2008/0024482 | A1 | 1/2008 | Gates et al. |
| 2008/0136774 | A1 | 6/2008 | Harris et al. |
| 2009/0122389 | A1 | 5/2009 | Whitesides et al. |
| 2009/0174651 | A1 | 7/2009 | Jacobson et al. |
| 2009/0315044 | A1 | 12/2009 | Amundson et al. |
| 2009/0322721 | A1 | 12/2009 | Zehner et al. |
| 2010/0220121 | A1 | 9/2010 | Zehner et al. |
| 2010/0265561 | A1 | 10/2010 | Gates et al. |
| 2011/0140744 | A1 | 6/2011 | Kazlas et al. |
| 2011/0187683 | A1 | 8/2011 | Wilcox et al. |
| 2011/0193840 | A1 | 8/2011 | Amundson et al. |
| 2011/0193841 | A1 | 8/2011 | Amundson et al. |
| 2011/0199671 | A1 | 8/2011 | Amundson et al. |
| 2011/0292319 | A1 | 12/2011 | Cole |
| 2013/0063333 | A1 | 3/2013 | Arango et al. |
| 2014/0009817 | A1 | 1/2014 | Wilcox et al. |
| 2014/0078024 | A1 | 3/2014 | Paolini, Jr. et al. |
| 2014/0253425 | A1 | 9/2014 | Zalesky et al. |
| 2015/0262255 | A1 | 9/2015 | Khajehnouri et al. |

* cited by examiner

510

| Row \ Column | 1 | 2 | 3 | 4 | 5 |
|---|---|---|---|---|---|
| 1 | 4 | 2 | 3 | 2 | 1 |
| 2 | 2 | 1 | 4 | 4 | 3 |
| 3 | 1 | 4 | 3 | 1 | 2 |
| 4 | 2 | 3 | 1 | 2 | 1 |
| 5 | 3 | 4 | 2 | 1 | 4 |

FIG. 5

METHODS AND CIRCUITRY FOR DRIVING DISPLAY DEVICES

REFERENCE TO RELATED APPLICATIONS

This application is a continuation of U.S. application Ser. No. 15/165,795, filed on May 26, 2016, which claims priority to U.S. Provisional Application No. 62/167,065, filed May 27, 2015.

TECHNICAL FIELD

This disclosure relates to electro-optic devices and methods and, more particularly, to methods and circuitry for driving electro-optic displays.

BACKGROUND

Signs are an emerging application of electro-optic displays. Such signs are usually characterized by large dimensions in comparison with common electro-optic displays, such as those used in portable reader and other display devices, and relatively infrequent updates of the displayed information. Techniques for driving such displays include a tiled active matrix and direct drive on the back of the printed circuit board of the display device. Both methods have drawbacks.

Because of the large pixel count of such display devices, the active matrix approach requires high frequency drivers which are expensive and consume a large amount of power. Furthermore, due to the large distances involved, transmission line effects become significant and require local driver circuitry.

Direct drive displays alleviate some of these issues by mounting the electronics on the back of the printed circuit board and distributing the electronics across the display device. The direct driver circuitry communicates with a host to receive update information. The local driver then generates the signals to update each directly driven pixel in its region via a dedicated wire. For a large display, a large number of such local drivers is required, and the drivers must be individually mounted and wired.

SUMMARY

The inventor has recognized that advantageous operation of a display device is obtained by using several iterations of a process including a scan phase followed by a global drive phase. In the scan phase, the state of each pixel of the display device is set to either "enabled" or "disabled", during which time a global drive generator is inactive. The scan can be performed in one scan frame using a long frame time, thereby allowing the use of inexpensive electronic drivers. Then, in the global drive phase, a global drive signal is sent to the display device. Only the subset of enabled pixels is affected by the global drive signal, which causes the enabled pixels to perform a transition to a desired display state. Because the drive signal is global, only a single drive circuit is required to provide a complex voltage sequence. The sequence of the scan phase followed by the global drive phase is then repeated up to the number of unique transitions required to update the display device.

In one implementation, all pixels are first enabled and receive a drive signal that transitions all pixels to an initial display state. Then, in succession each display state is set by applying respective drive signals to respective subsets of pixels of the display device. In another implementation, the pixels of each subset of pixels are transitioned to the initial display state during the global drive phase and prior to applying the drive signal for each unique transition. In yet another implementation, all possible transitions between optical states are performed without transitioning the pixels to an initial display state.

The method applies but is not limited to display devices that have large enough pixels that blooming artifacts induced by asynchronous updates of adjacent pixels are not significant to quality, and display devices that can be updated slowly without regard to transition appearance. The time required to perform an update is not a significant issue for an electronic signage application where updates are infrequently. Examples of such electronic signage include but are not limited to menu board signs, hotel welcome signs, event schedules, airport signs, train station signs, etc.

According to a first aspect of the disclosed technology, a method for operating a display device including pixels comprises enabling a first subset of pixels of the display device, the first subset of pixels corresponding to a first display state; transitioning the enabled first subset of pixels to the first display state; and repeating the enabling and the transitioning for a second subset of pixels corresponding to a second display state.

According to a second aspect of the disclosed technology, a display system comprises a display device including a display medium, a common electrode on a first surface of the display medium and pixel electrodes on a second surface of the display medium, the pixel electrodes defining pixels of the display device; pixel circuitry configured to enable a first subset of pixels of the display device, the first subset of pixels corresponding to a first display state; a drive circuit configured to transition the enabled subset of pixels to the first display state; and a control circuit configured to control the pixel circuitry and the drive circuit to repeat the enabling and the transitioning for a second subset of pixels corresponding to a second display state.

According to a third aspect of the disclosed technology, a display system comprises a display device including a display medium having two or more stable states and pixel electrodes defining pixels of the display device; and a pixel circuit associated with each of the pixels of the display device, each pixel circuit including: a first transistor configured to receive a pixel enable voltage on the source and a select voltage on the gate; a holding capacitor coupled between the drain of the first transistor and a reference voltage; and a second transistor having the gate coupled to the drain of the first transistor, the source coupled to the pixel electrode of the associated pixel and the drain coupled to the reference voltage.

BRIEF DESCRIPTION OF THE DRAWINGS

Various aspects and embodiments of the technology will be described with reference to the following figures. It should be appreciated that the figures are not necessarily drawn to scale. Items appearing in multiple figures are indicated by the same reference number in all of the figures in which they appear.

FIG. 5 is a simplified schematic diagram of a display device having pixels with different display states;

DETAILED DESCRIPTION

Figure 1:
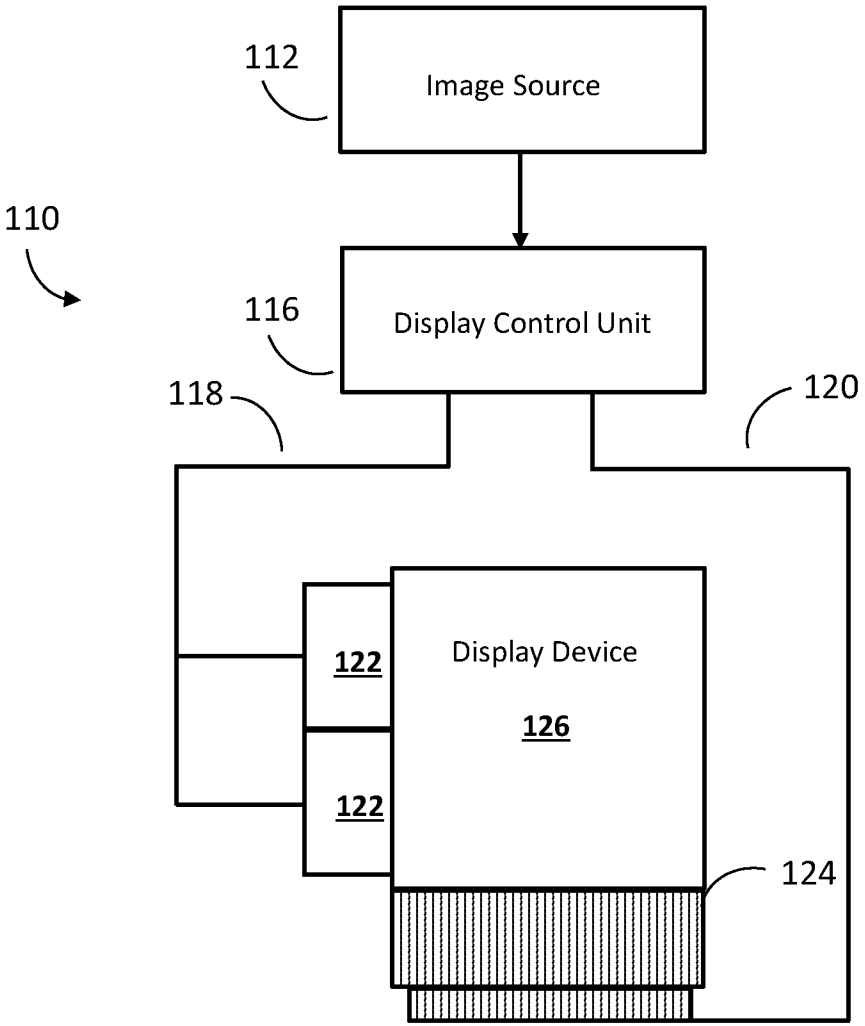
FIG. 1 is a schematic block diagram of a display system in accordance with some embodiments.

The term "electro-optic", as applied to a material or a display, is used herein in its conventional meaning in the imaging art to refer to a material having first and second display states differing in at least one optical property, the material being changed from its first to its second display state by application of an electric field to the material. Although the optical property is typically color perceptible to the human eye, it may be another optical property, such as optical transmission, reflectance, luminescence or, in the case of displays intended for machine reading, pseudo-color in the sense of a change in reflectance of electromagnetic wavelengths outside the visible range.

The term "gray state" is used herein in its conventional meaning in the imaging art to refer to a state intermediate two extreme optical states of a pixel, and does not necessarily imply a black-white transition between these two extreme states. For example, several of the E Ink patents and published applications referred to below describe electrophoretic displays in which the extreme states are white and deep blue, so that an intermediate "gray state" would actually be pale blue. Indeed, as already mentioned, the change in optical state may not be a color change at all. The terms "black" and "white" may be used hereinafter to refer to the two extreme optical states of a display, and should be understood as normally including extreme optical states which are not strictly black and white, for example the aforementioned white and dark blue states, or any other colors. The term "monochrome" may be used hereinafter to denote a drive scheme which only drives pixels to their two extreme optical states with no intervening gray states.

Numerous patents and applications assigned to or in the names of the Massachusetts Institute of Technology (MIT) and E Ink Corporation describe various technologies used in encapsulated electrophoretic and other electro-optic media. Such encapsulated media comprise numerous small capsules, each of which itself comprises an internal phase containing electrophoretically-mobile particles in a fluid medium, and a capsule wall surrounding the internal phase. Typically, the capsules are themselves held within a polymeric binder to form a coherent layer positioned between two electrodes. The technologies described in these patents and applications include:

(a) Electrophoretic particles, fluids and fluid additives; see for example U.S. Pat. Nos. 7,002,728 and 7,679,814;

(b) Capsules, binders and encapsulation processes; see for example U.S. Pat. Nos. 6,922,276 and 7,411,719;

(c) Films and sub-assemblies containing electro-optic materials; see for example U.S. Pat. Nos. 6,982,178 and 7,839,564;

(d) Backplanes, adhesive layers and other auxiliary layers and methods used in displays; see for example U.S. Pat. Nos. D485,294; 6,124,851; 6,130,773; 6,177,921; 6,232,950; 6,252,564; 6,312,304; 6,312,971; 6,376,828; 6,392,786; 6,413,790; 6,422,687; 6,445,374; 6,480,182; 6,498,114; 6,506,438; 6,518,949; 6,521,489; 6,535,197; 6,545,291; 6,639,578; 6,657,772; 6,664,944; 6,680,725; 6,683,333; 6,724,519; 6,750,473; 6,816,147; 6,819,471; 6,825,068; 6,831,769; 6,842,167; 6,842,279; 6,842,657; 6,865,010; 6,967,640; 6,980,196; 7,012,735; 7,030,412; 7,075,703; 7,106,296; 7,110,163; 7,116,318; 7,148,128; 7,167,155; 7,173,752; 7,176,880; 7,190,008; 7,206,119; 7,223,672; 7,230,751; 7,256,766; 7,259,744; 7,280,094; 7,327,511; 7,349,148; 7,352,353; 7,365,394; 7,365,733; 7,382,363; 7,388,572; 7,442,587; 7,492,497; 7,535,624; 7,551,346; 7,554,712; 7,583,427; 7,598,173; 7,605,799; 7,636,191; 7,649,674; 7,667,886; 7,672,040; 7,688,497; 7,733,335; 7,785,988; 7,843,626; 7,859,637; 7,893,435; 7,898,717; 7,957,053; 7,986,450; 8,009,344; 8,027,081; 8,049,947; 8,077,141; 8,089,453; 8,208,193; 8,373,211; 8,389,381; 8,498,042; 8,610,988; 8,728,266; 8,754,859; 8,830,560; 8,891,155; 8,969,886; 9,152,003; and 9,152,004; and U.S. Patent Applications Publication Nos. 2002/0060321; 2004/0105036; 2005/0122306; 2005/0122563; 2007/0052757; 2007/0097489; 2007/0109219; 2009/0122389; 2009/0315044; 2011/0026101; 2011/0140744; 2011/0187683; 2011/0187689; 2011/0292319; 2013/0278900; 2014/0078024; 2014/0139501; 2014/0300837; 2015/0171112; 2015/0205178; 2015/0226986; 2015/0227018; 2015/0228666; and 2015/0261057; and International Application Publication No. WO 00/38000; European Patents Nos. 1,099,207 B 1 and 1,145,072 B 1;

(e) Color formation and color adjustment; see for example U.S. Pat. Nos. 7,075,502 and 7,839,564;

(f) Methods for driving displays; see for example U.S. Pat. Nos. 5,930,026; 6,445,489; 6,504,524; 6,512,354; 6,531,997; 6,753,999; 6,825,970; 6,900,851; 6,995,550; 7,012,600; 7,023,420; 7,034,783; 7,116,466; 7,119,772; 7,193,625; 7,202,847; 7,259,744; 7,304,787; 7,312,794; 7,327,511; 7,453,445; 7,492,339; 7,528,822; 7,545,358; 7,583,251; 7,602,374; 7,612,760; 7,679,599; 7,688,297; 7,729,039; 7,733,311; 7,733,335; 7,787,169; 7,952,557; 7,956,841; 7,999,787; 8,077,141; 8,125,501; 8,139,050; 8,174,490; 8,289,250; 8,300,006; 8,305,341; 8,314,784; 8,373,649; 8,384,658; 8,558,783; 8,558,785; 8,593,396; and 8,928,562; and U.S. Patent Applications Publication Nos. 2003/0102858; 2005/0253777; 2007/0091418; 2007/0103427; 2008/0024429; 2008/0024482; 2008/0136774; 2008/0291129; 2009/0174651; 2009/0179923; 2009/0195568; 2009/0322721; 2010/0220121; 2010/0265561; 2011/0193840; 2011/0193841; 2011/0199671; 2011/0285754; 2013/0063333; 2013/0194250; 2013/0321278; 2014/0009817; 2014/0085350; 2014/0240373; 2014/0253425; 2014/0292830; 2014/0333685; 2015/0070744; 2015/0109283; 2015/0213765; 2015/0221257; and 2015/0262255;

(g) Applications of displays; see for example U.S. Pat. Nos. 7,312,784 and 8,009,348; and (h) Non-electrophoretic displays, as described in U.S. Pat. Nos. 6,241,921; 6,950,220; 7,420,549 and 8,319,759; and U.S. Patent Application Publication No. 2012/0293858.

The inventor has recognized that advantageous operation of a display device is obtained by using several iterations of a process including a scan phase followed by a global drive phase. In the scan phase, the state of each pixel of the display device is set to either "enabled" or "disabled", during which time a global drive generator is inactive. The scan can be performed in one scan frame using a long frame time, thereby allowing the use of inexpensive electronic drivers. Then, in the global drive phase, a global drive signal is sent to the display device. Only the subset of enabled pixels is affected by the global drive signal, which causes the enabled pixels to perform a transition to a desired display state. Because the drive signal is global, only a single drive circuit is required to provide a complex voltage sequence. The sequence of the scan phase followed by the global drive phase is then repeated up to the number of unique transitions required to update the display device.

In one implementation, all pixels are first enabled and receive a drive signal that transitions all pixels to an initial display state. Then, in succession each display state is set by applying respective drive signals to respective subsets of pixels of the display device. In another implementation, the pixels of each subset of pixels are transitioned to the initial display state during the global drive phase and prior to applying the drive signal for each unique transition. In yet another implementation, all possible transitions between optical states are performed without transitioning the pixels to an initial display state.

The method applies but is not limited to display devices that have large enough pixels that blooming artifacts induced by asynchronous updates of adjacent pixels are not significant to quality, and display devices that can be updated slowly without regard to transition appearance. The time required to perform an update is not a significant issue with electronic signage where updates are infrequently. Examples of such electronic signage include but are not limited to menu board signs, hotel welcome signs, event schedules, airport signs, train station signs, etc.

In some implementations, all pixels in the display are updated to a next display state. In some implementations, only a portion of the pixels in the display are updated to a next display state. For example, when a train departure schedule is updated to add another train departure at the bottom of the list; only those pixels displaying the new train departure are enabled and transitioned to the next display state. In another example, when a new color such as red is added to an image being displayed, only pixels having red as a next display state are enabled and transitioned.

An example of a display system 110 suitable for incorporating embodiments and aspects of the present disclosure is shown in FIG. 1. The display system 110 may include an image source 112, a display control unit 116 and a display device 126. The image source 112 may, for example, be a computer having image data stored in its memory, a camera, or a data line from a remote image source. The image source 112 may supply image data representing an image to the display control unit 116. The display control unit 116 may generate a first set of output signals on a first data bus 118 and a second set of signals on a second data bus 120. The first data bus 118 may be connected to row drivers 122 of display device 126, and the second data bus 120 may be connected to column drivers 124 of display device 126. The row and column drivers control the operation of display device 126. In one example, display device 126 is an electrophoretic display device. The display control unit 116 may include circuitry for operating the display device 126, including circuitry for performing the operations described herein.

The disclosed technology relates to so-called "bistable" display devices. The term "bistable" is used herein in its conventional meaning in the art to refer to displays including display elements having first and second display states differing in at least one optical property, and such that after any given element has been driven by an addressing pulse, to assume either its first or second display state. After the addressing pulse has terminated, the display state will persist for at least several times the duration of the addressing pulse required to change the state of the display element. It is known that some particle-based electrophoretic displays capable of gray scale are stable not only in black and white states but also in their intermediate gray states, and this is true of some other types of electro-optic displays. This type of display is properly called "multi-stable" rather than bistable, although for convenience the term "bistable" may be used herein to cover both bistable and multi-stable displays. The same is true of particle-based displays having two or more colored pigment particles where different color states are stable. The term bistable may refer to different color states that are persist for at least several times the duration of the addressing pulse required to change the state of the display element after the addressing pulse is terminated.

Bistable electro-optic displays act, to a first approximation, as impulse transducers, so that the final display state of a pixel depends not only upon the electric field applied and the time for which the electric field is applied, but also on the display state of the pixel prior to the application of the electric field. Furthermore, at least in the case of many particle-based electro-optic displays, the impulses necessary to change a given pixel through equal changes in gray level are not necessarily constant. These problems can be reduced or overcome by driving all pixels of the display device to an initial display state, such as white, before driving the required pixels to other display states.

Figure 2:
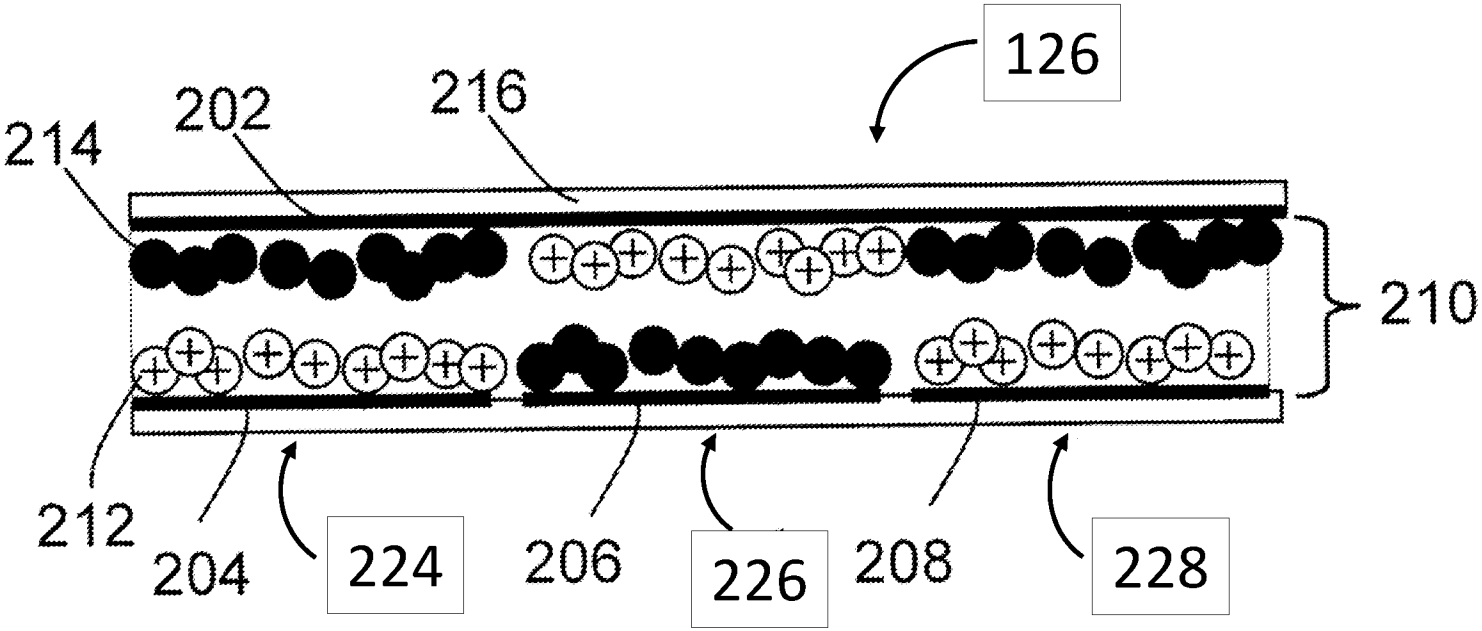
FIG. 2 is a schematic cross-sectional diagram of a display device in accordance with some embodiments.

A cross-sectional view of an example display architecture of display device 126 is shown in FIG. 2. The display architecture may include a single common transparent electrode 202 on one side of an electro-optic layer 210, the common electrode 202 extending across all pixels of the display device. The common electrode 202 may therefore be considered a front electrode and may represent the viewing side 216 of the display 126. The common electrode 202 may be a transparent conductor, such as Indium Tin Oxide (ITO) (which in some cases may be deposited onto a transparent substrate, such as polyethylene terephthalate (PET)). The common electrode 202 is disposed between the electro-optic layer 210 and an observer, and forms a viewing surface 216 through which an observer views the display. A matrix of pixel electrodes arranged in rows and columns is disposed on the opposite side of the electro-optic layer 210. Each pixel electrode is defined by the intersection of a row and column of the matrix of pixel electrodes. In the example of FIG. 2, pixel electrodes 204, 206 and 208 define pixels 224, 226 and 228, respectively. Although three pixel electrodes 204, 206 and 208 are shown in FIG. 2, any suitable number of pixels may be used for the display device 126. The pixel electrodes 204, 206, and 208 may be considered rear electrodes, forming part of a backplane of the display device.

Other electrode arrangements may be utilized within the scope of the disclosed technology. The electric field applied to each pixel of the electro-optic layer 210 is controlled by varying the voltage applied to the associated pixel electrode relative to the voltage applied to the common electrode.

The electro-optic layer 210 may include any suitable electro-optic medium. In the example of FIG. 2, the electro-optic layer includes positively charged white particles 212 and negatively charged black particles 214. The electric field applied to a pixel may alter the display state by positioning particles 212 and 214 within the space between the common electrode and the pixel electrode such that the particles closer to the viewing surface 216 determine the display state. In the embodiment of FIG. 2, pixels 224 and 228 are in a black state, and pixel 226 is in a white state. The information on such a display may be referred to as having a one-bit depth. A gray display state may be formed by applying a voltage signal to create a mixture of black and white particles visible by the observer through the viewing surface 216. Multiple gray states may be formed by applying appropriate voltage signals to the electrodes. The electro-optic layer 210 of FIG. 2 is representative of a microcapsule type electrophoretic medium.

Aspects of disclosed technology may also be used in connection with microcell type electrophoretic displays and polymer dispersed electrophoretic image displays (PDEPIDs). Moreover, although electrophoretic displays represent a suitable type of display according to aspects of the disclosed technology, other types of displays may also utilize one or more aspects of the disclosed technology. For example, Gyricon displays, electrochromic displays, and polymer dispersed liquid crystal displays (PDLCD) may also take advantage of aspects of the disclosed technology.

Figure 3:
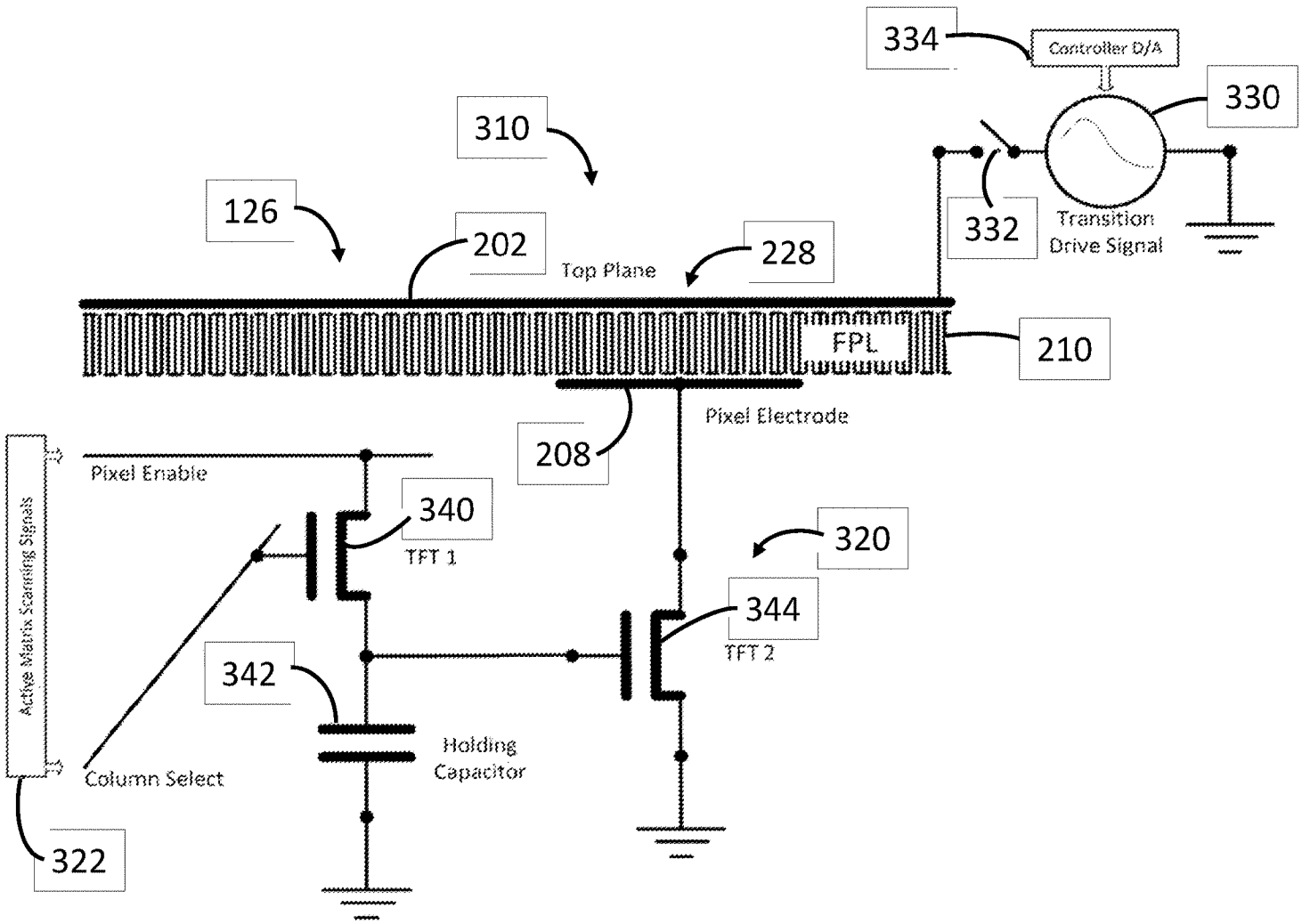
FIG. 3 is a schematic diagram of a display system in accordance with some embodiments.

A schematic diagram of drive circuitry of a display system 310 in accordance with embodiments is shown in FIG. 3. The display system 310 includes display device 126 as described above, including common electrode 202, electro-optic layer 210 and pixel electrode 208 defining pixel 228. Although a single pixel electrode is shown in FIG. 3, it will be understood that the display device 126 includes a matrix of pixel electrodes arranged in rows and columns. The display system 310 further includes a pixel circuit 320 having an output coupled to pixel electrode 208 and inputs connected to a scanning circuit 322. The scanning circuit 322 may be part of the display control unit 116 shown in FIG. 1 and described above. The pixel circuit 320 is repeated for each pixel of display device 126. In some embodiments, pixel circuit 320 may be integrated on a printed circuit board on which display device 126 is mounted, and each pixel circuit 320 may be located behind the pixel electrode to which it is connected. Preferably, the pixel circuit is an integrated amorphous silicon backplane fabricated by photolithography, or any other known process for fabricating large integrated circuits.

The display system 310 further includes a transition drive generator 330 connected between common electrode 202 of display device 126 and a reference voltage, such as ground. In the embodiment of FIG. 3, a switch 332 is connected in series with transition drive generator 330 to permit the transition drive generator 330 to be disconnected from common electrode 202. The transition drive generator 330 receives an input from a digital-to-analog converter 334 which may be part of display control unit 116 shown in FIG. 1 and described above. Typically, a switch 332 would be electrically controlled by a display controller, for example, by a MOSFET, an electro-optic isolator or a solid state relay. As a transition drive generator provides a continuous time voltage signal to effect a transition, a signal may be created by reading digital values from a memory and using a digital time analog converter to generate the time voltage signal.

Referring again to FIG. 3, pixel circuit 320 may include a first transistor 340 having the gate connected to a column select line of scanning circuit 322 and the source connected to a pixel enable line of scanning circuit 322. The drain of first transistor 340 is connected to a first terminal of a holding capacitor 342 and to the gate of a second transistor 344. The second terminal of holding capacitor 342 is connected to ground. The source of a second transistor 344 is connected to pixel electrode 208, and the drain of the second transistor 344 is connected to ground. A separate pixel circuit 320 is connected to each pixel electrode of display device 126. Typically, one of the source and drain is connected to the pixel electrode and the other of the source and drain is connected to ground. It will be apparent to a person of ordinary skill in the art that the source and drain may be interchanged.

The pixel circuit 320 functions to either enable or disable each pixel of the display device 126 during operation of the display system 310 as described below. In particular, the matrix of pixel electrodes is scanned and each pixel of the display device 126 is either enabled or disabled. The pixels are enabled or disabled in a scanning process. With reference to FIG. 3, the scanning circuit 322 applies a column select voltage to the gate of the first transistor 340 of each pixel circuit in a selected column. The scanning circuit 322 also applies a pixel enable signal to the source of the first transistor 340 of each pixel circuit in the selected column, according to whether the particular pixel is to be enabled or disabled. For pixels that are to be enabled, the pixel enable voltage is set to a "voltage high" which will charge the holding capacitor to that voltage. If the pixel is to be disabled, the pixel enable voltage is set to "voltage low" which will charge the holding capacitor to that voltage. "Voltage high" is chosen to be sufficient to turn on transistor 344 during the application of the transition drive signal and "Voltage Low" is chosen to be sufficient to ensure that transistor 344 would remain off during driving. The scanning process is repeated for each column of the display device 126, so that all pixels in the display device 126 are either enabled or disabled.

The selection of pixels to be enabled is based on the image data for the image to be displayed and, in particular, on the pixels in the image which have a selected display state. For example, all the pixels in the image having a display state of gray level 3 are enabled in a scan phase. The enabling or disabling of each pixel of display device 126 determines whether the pixel will undergo a transition when the transition drive generator 330 is applied to common electrode 202.

By way of example only, the gate voltage of first transistor 340 can be a positive voltage, such as +20 volts, when the column is selected and a negative voltage, such as −20 volts, when the column is not selected. The pixel enable line connected to the source of first transistor 340 may be set to a positive voltage, such as +20 volts, if the pixel is to be enabled and may be set to a negative voltage, such as −20 volts, if the pixel is to be disabled. The address time and voltages are chosen such that the holding capacitor 342 charges to above approximately 95% of the full voltage level, or multiple matrix scan frames can be used to charge holding capacitor 342. The actual voltage on holding capacitor 342 is not important, provided that the voltage is sufficient to turn on second transistor for the given transistor drive signal 344. After a scan is completed, an enabled pixel will have a voltage of approximately +20 volts, in the above example, stored on the holding capacitor 342, whereas a disabled pixel will have a voltage of approximately −20 volts stored on the holding capacitor 342. The holding capacitor 342 is large enough to hold the required voltage level during the global drive phase discussed below. In an alternative approach, the matrix can be rescanned during the global drive phase to recharge the holding capacitor 342.

The second transistor 344 is used to switch the pixel electrode 208 to ground. The holding capacitor 342 controls the gate of the second transistor 344. If the voltage on the gate of the second transistor 344 is high (+20 volts), then a low impedance path to ground is provided for drive voltages that do not exceed 20V minus the threshold voltage of the transistor. If the gate voltage of second transistor 344 provided by the holding capacitor 342 is low (−20 volts), the pixel electrode 208 will have a very high impedance connection to ground, effectively floating the pixel.

Figure 4:
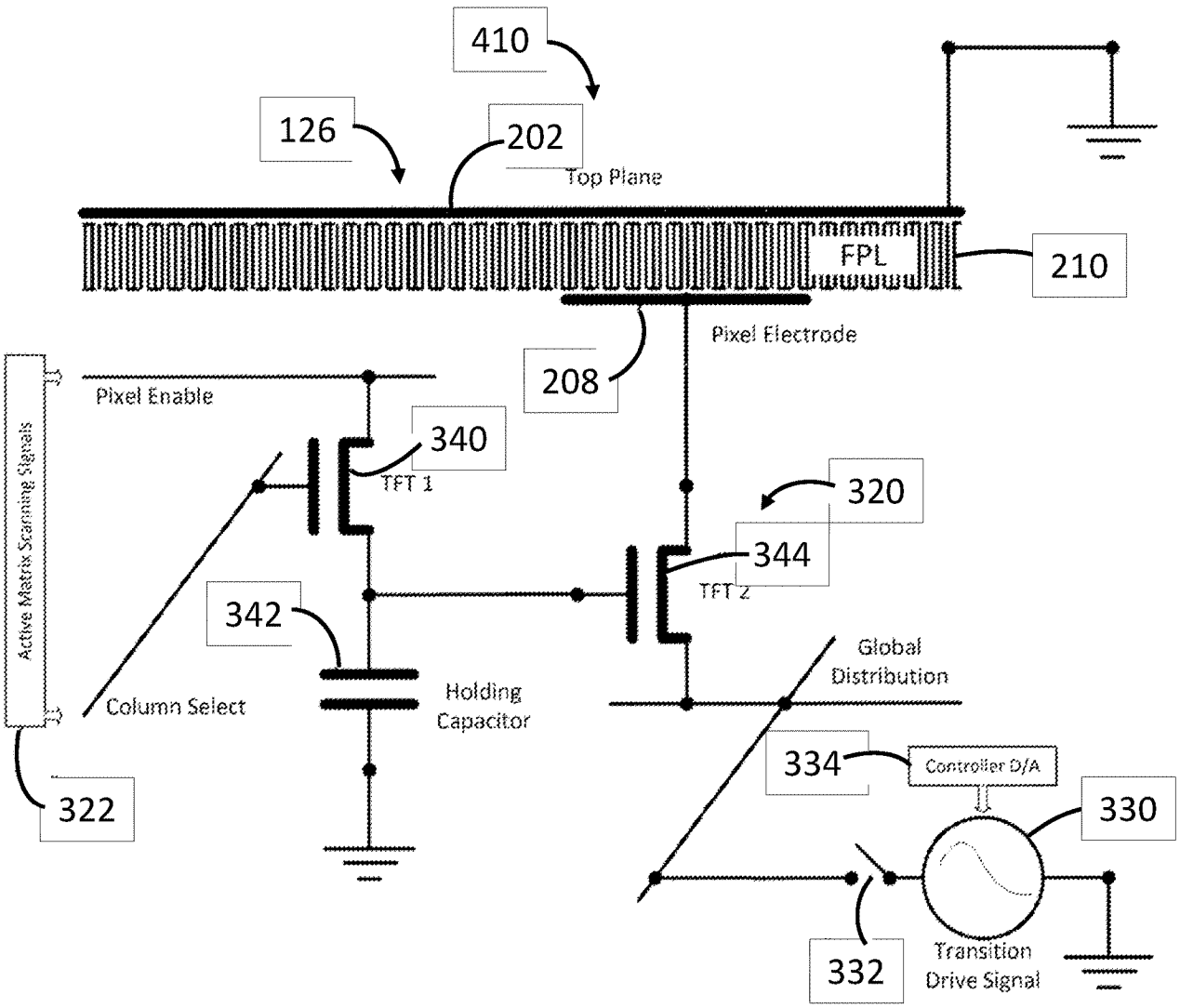
FIG. 4 is a schematic diagram of a display system in accordance with some embodiments.

A display system 410 in accordance with additional embodiments is shown in the schematic diagram of FIG. 4. The display system 410 of FIG. 4 is similar to the display system 310 of FIG. 3, except that transition drive generator 330 and switch 332 are connected in series with the drain of the second transistor 344 of each pixel in the display device 126. Thus, second transistor 344, switch 332 and transition drive generator 330 are connected in series between pixel electrode 208 and ground. The switch 332 and the transition drive generator 330 are connected to the drain of the second transistor associated with each pixel in the display device 126. In the embodiment of FIG. 4, common electrode 202 is connected to ground. The embodiment of FIG. 4 operates in the same manner as the embodiment of FIG. 3.

In general, operation of the display systems 310 and 410 may be described as including (1) a scan phase in which all pixels of the display device 126 are either enabled or disabled, and (2) a global drive phase in which the enabled pixels are transitioned to a selected display state. Phases (1) and (2) are repeated for a number of display states to produce a desired image. The subset of pixels which are enabled in the scan phase corresponds to pixels having a selected display state in the image to be displayed. The number of display states and thus the number of iterations of phases (1) and (2) depends on the number of gray levels or color levels that can be displayed by the display device.

An example of a display device 510 having a matrix of five columns and five rows of pixels is shown in FIG. 5. The display device 510 of FIG. 5 is merely for illustration, and a practical implementation will have a larger number of pixels. Each pixel in the display device 510 has an associated display state. Thus, for example, the pixel at column 3, row 2 has a display state of 4, and the pixel at column 4, row 5 has a display state of 1. The display states in FIG. 5 are merely for illustration. Further, the display device 510 of FIG. 5 may have more or fewer display states, depending on the number of gray levels or color levels that can be displayed by the display device 510. As described previously, in some embodiments, only a portion of the display device 510 may be transitioned, so only some pixels in the display device 510 will have an associated display state. For pixels that are not transitioning to a next display state, this subset of pixels may be skipped (not enabled and not transitioned), or may be enabled and may experience a null transition (i.e., no voltage is applied to the pixel during this transition) during the global drive phase.

Now, an example of operation of the display system is described with reference to FIG. 5. As indicated above, the operation of the display system includes a number of iterations of (1) a scan phase in which the pixels of the display device are either enabled or disabled, and (2) a global drive phase in which the enabled pixels are transitioned to a selected display state.

Referring again to FIG. 5, a scan of the display device 510 is performed for display state 1. In particular, a scan phase is performed in which all pixels of the display device 510 to be transitioned to display state 1 are enabled. The scan phase begins by addressing column 1 of display device 510 and enabling the pixel at column 1, row 3 using the pixel circuit 320 shown in FIG. 3 and described above. As shown in FIG. 5, the pixel at column 1, row 3 is the only pixel in column 1 having display state 1. Next, column 2 is addressed and the pixel at column 2, row 2, having display state 1, is enabled. The scanning continues and enables the pixels having display state 1 at column 3, row 4, column 4, rows 3 and 5 and column 5, rows 1 and 4. At this stage, all the pixels in display device 510 having display state 1 are enabled, and the remaining pixels are disabled.

The process now proceeds to the global drive phase in which the enabled pixels are transitioned to the selected display state. In particular, the transition drive generator 330 is enabled and/or connected to common electrode 202 of the display device and a suitable transition drive signal is applied to all the pixels of the display device. However, only those pixels which have been enabled in the scan phase are transitioned to display state 1.

Then the next iteration of the scan phase and the global drive phase is performed. In particular, a scan phase in which all pixels of the display device 510 to be transitioned to display state 2 is performed. The scan phase includes addressing column 1 and enabling the pixels at column 1, rows 2 and 4. Then column 2 is addressed and the pixel at column 2, row 1 is enabled. The scan phase is continued to enable the pixels at column 3, row 5, column 4, rows 1 and 4 and column 5, row 3. Thus, all pixels of display device 510 having display state 2 are enabled. In the global drive phase, the transition drive signal is applied to common electrode 202 of the display device, thereby transitioning the enabled pixels to the display state 2. It will be understood that the transition drive generator 330 (FIG. 3) applies different transition drive signals to the display device to transition to different display states.

The iterations of the scan phase and the global drive phase are then repeated for display states 3 and 4 so as to complete the image. As discussed above, in a practical implementation, the display device has a larger number of pixels and may be capable of displaying more or fewer display states. The display states which form the image on display device 510 may be stored in a memory in display control unit 116 (FIG. 1). The pixel locations having a specified display state are supplied to the display device 510 by the display control unit 116.

Figure 6:
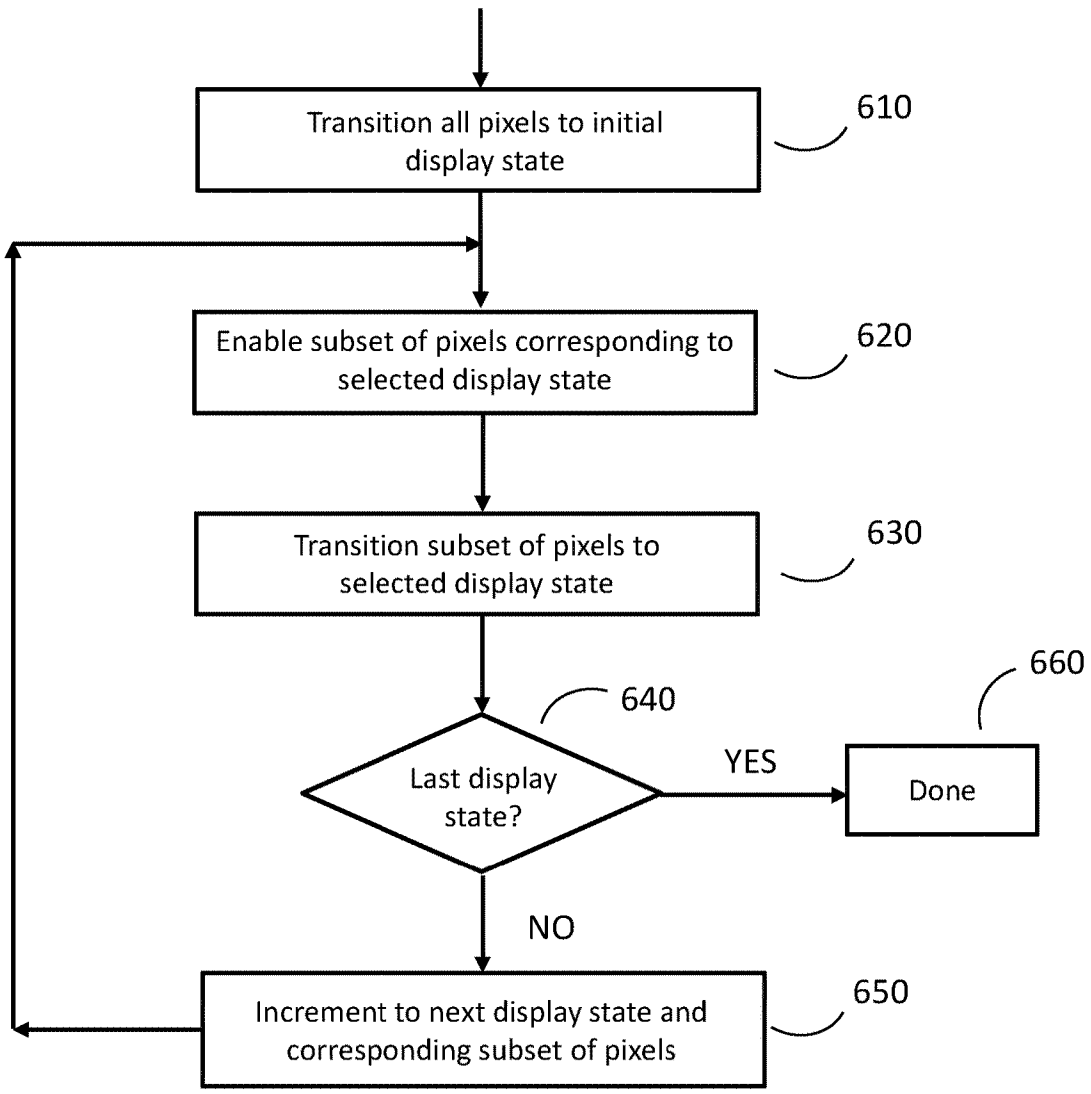
FIG. 6 is a flow chart of a method for operating a display device in accordance with some embodiments.

A flow chart of a method for operating a display device in accordance with embodiments is shown in FIG. 6. The method of FIG. 6 may be performed by a display system of the type shown in FIGS. 1 and 3 or FIGS. 1 and 4 using a display device of the type shown in FIG. 2. The method may include additional acts not shown in FIG. 6, and the acts may be performed in a different order.

In act 610, all pixels are transitioned to an initial display state, such as white or black. The transition of all pixels to the initial display state can be performed by enabling all pixels, as discussed above, and then applying to the common electrode 202 a transition drive signal of sufficient voltage and duration to drive the pixels to the initial display state.

In act 620, the pixels in a subset of pixels corresponding to a selected display state are enabled, as described above in connection with FIGS. 3 and 5. The pixels in the subset of pixels are enabled by charging holding capacitor 342 (FIG. 3) for each pixel in the subset to a voltage sufficient to turn on second transistor 344. With reference to FIG. 5, a subset of pixels corresponding to display state 2 includes the pixel at column 1, row 2, the pixel at column 1, row 4, the pixel at column 2, row 1, the pixel at column 3, row 5, the pixel at column 4, row 1, the pixel at column 4, row 4 and the pixel at column 5, row 3. The pixels in this subset of pixels are enabled in act 620, and all other pixels of the display device are disabled by not charging (or discharging) the respective holding capacitors.

In act 630, the subset of pixels that was enabled in act 620 is transitioned to the selected display state. The transition is performed by enabling the transition drive generator 330 and applying a transition drive signal suitable to transition the subset of pixels from the initial display state to the selected display state. The disabled pixels are not affected by the transition drive signal.

In act 640, a determination is made as to whether the selected display state is the last display state among the available display states of the display device. In the above example, the subset of pixels was transitioned to selected display state 2. Accordingly, selected display state 2 is not the last display state and the process proceeds to act 650. In act 650, the process increments to the next display state, in this case display state 3, and a corresponding subset of pixels. The process then returns to act 620 to perform another iteration of enabling a subset of pixels and transitioning the enabled pixels to the selected display state. It will be understood that the different display states do not need to be processed in any particular order. In addition, it will be understood that a different subset of pixels corresponds to each selected display state. Further, an iteration can be skipped if no pixels are to be in the selected display state. If it is determined in act 640 that the selected display state is the last display state, the process is done, as indicated in block 660.

Figure 7:
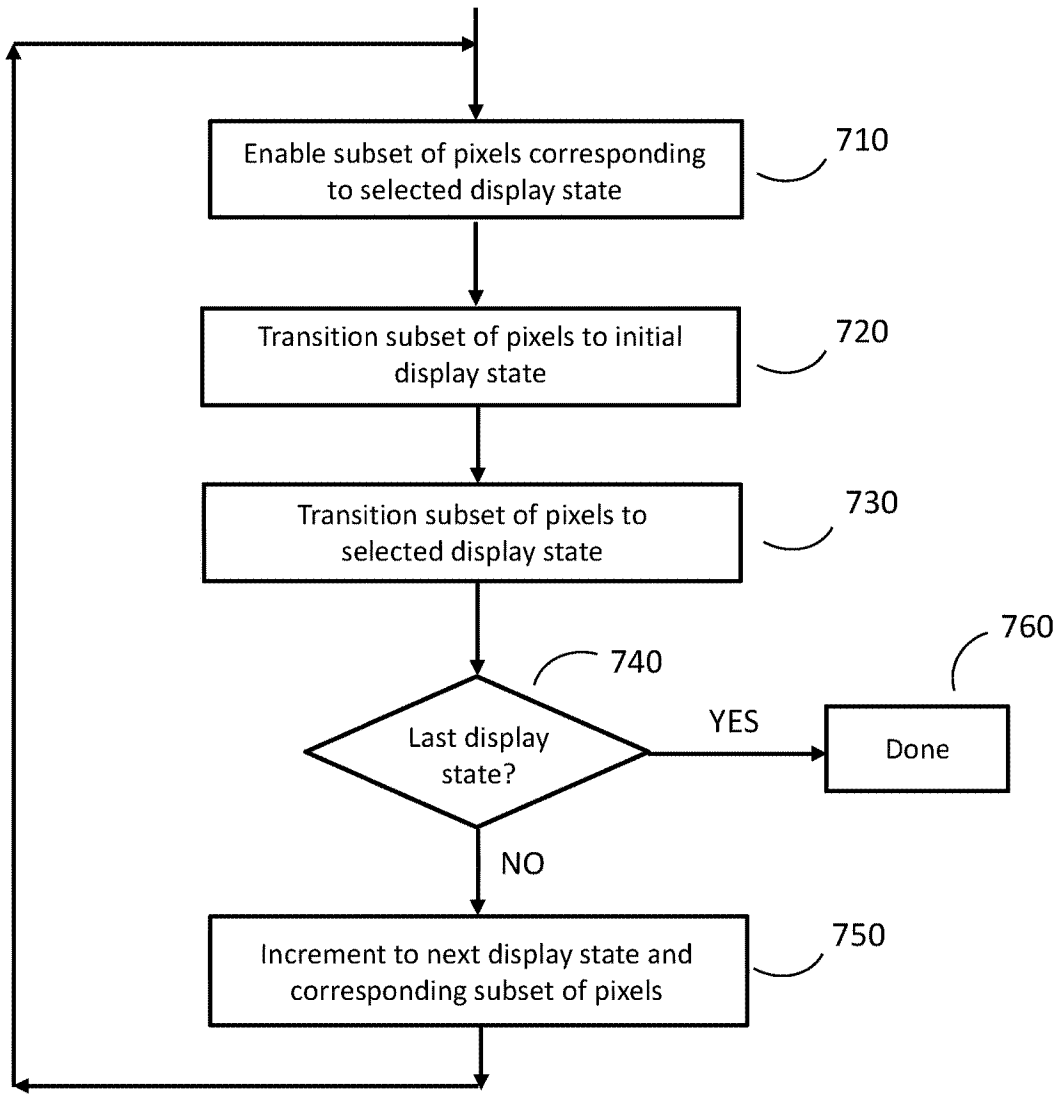
FIG. 7 is a flow chart of a method for operating a display device in accordance with some embodiments.

A flow chart of a method for operating a display device in accordance with additional embodiments is shown in FIG. 7. The embodiment of FIG. 7 differs from the embodiment of FIG. 6 primarily in that the transition of the pixels to the initial display state is performed for each subset of pixels in succession after the subset of pixels has been enabled. In contrast, all pixels of the display device are transitioned to the initial display state at one time in act 610.

Referring to FIG. 7, the pixels in a subset of pixels corresponding to a selected display state are enabled in act 710. The enabling of the pixels in act 710 may be performed in the manner described above in connection with act 620. As in act 620, pixels not in the subset of pixels are disabled.

In act 720, the pixels in the subset of pixels that were enabled in act 710 are transitioned to the initial display state. The transition of the subset of pixels to the initial display state can be performed by activating the transition drive generator 330 and applying a suitable transition drive signal to the enabled pixels in the subset of pixels.

In act 730, the enabled set of pixels is transitioned from the initial display state to the selected display state. The transition is performed by the transition drive generator 330 in the manner described above in connection with act 630.

In act 740, a determination is made as to whether the selected display state is the last display state. If the selected display state is not the last display state, the process proceeds to act 750 and increments to the next display state and a corresponding subset of pixels. The process then returns to act 710, and another iteration of the process is performed. If the selected display state is determined in act 740 to be the last display state, the process is done, as indicated in block 760.

Figure 8:
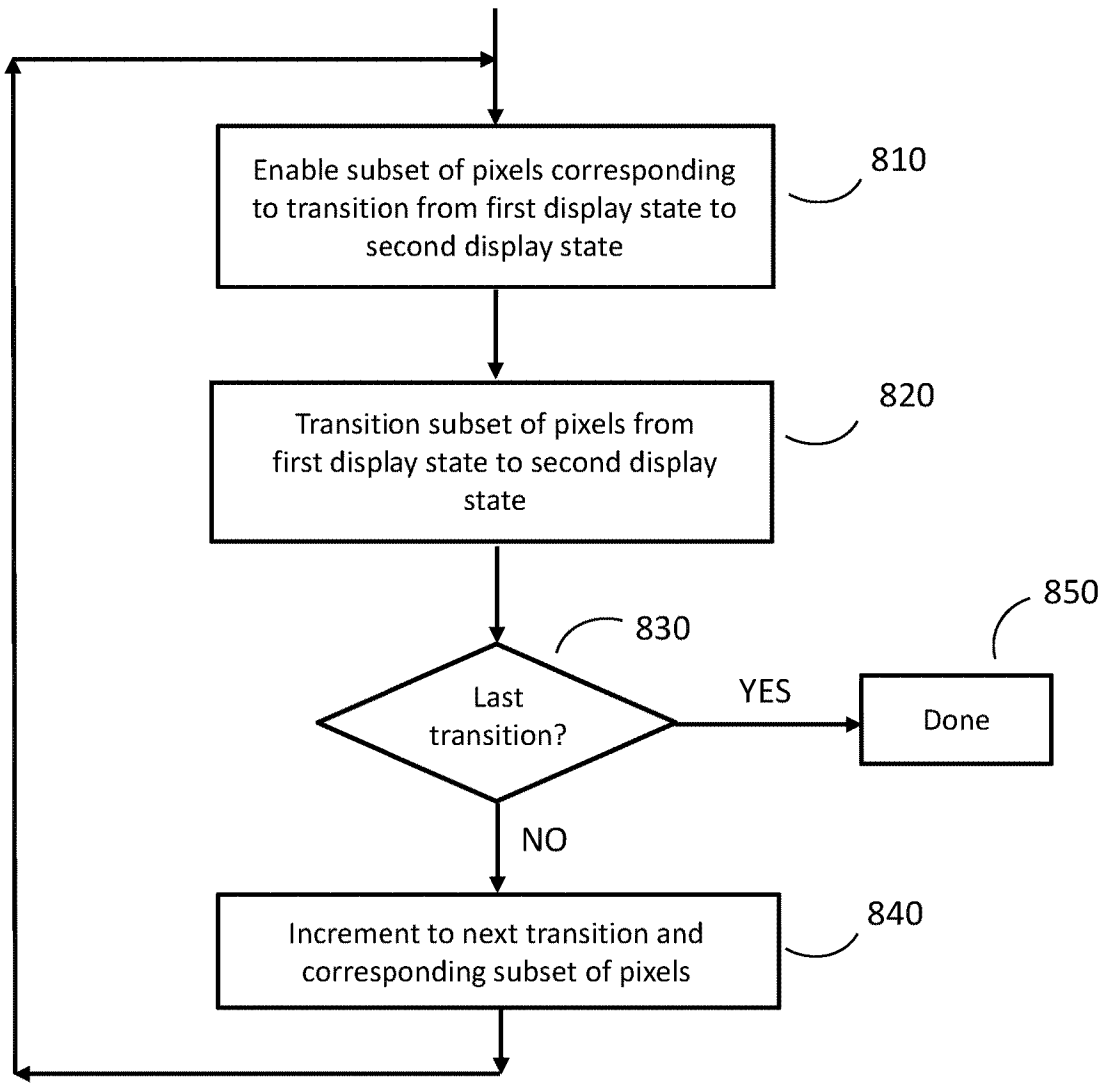
FIG. 8 is a flow chart of a method for operating a display device in accordance with some embodiments.

A flow chart of a process for operating a display device in accordance with further embodiments is shown in FIG. 8. The method of FIG. 8 differs from the methods of FIGS. 6 and 7 in that the pixels in the display device are not transitioned to an initial display state before being transitioned to the selected display state. These embodiments may result in a larger number of iterations of the process, but do not require transitioning to the initial display state.

In act 810, the pixels in a subset of pixels corresponding to a transition from a first display state to a second display state are enabled. Act 810 corresponds to act 620 shown in FIG. 6 and described above, except that the subset of pixels corresponds to the transition from the first display state to the second display state.

In act 820, the enabled subset of pixels is transitioned from the first display state to the second display state. The transition is performed by the transition drive generator 330 which applies a suitable drive signal to transition the enabled pixels from the first display state to the second display state.

In act 830, a determination is made as to whether the transition from the first display state to the second display state is the last transition among the possible transitions. If the transition from the first display state to the second display state is not the last transition, the process proceeds to act 840 and increments to the next transition and the corresponding subset of pixels. The process then returns to act 810 for another iteration of the process. If the transition is determined in act 830 to be the last transition, the process is done, as indicated in block 850.

The above-described embodiments can be implemented in any of numerous ways. One or more aspects and embodiments of the disclosure involving the performance of processes or methods may utilize program instructions executable by a device (e.g., a computer, a processor, or other device) to perform, or control performance of, the processes or methods. Various concepts and features may be embodied as a computer-readable storage medium or multiple computer-readable storage media (e.g., a computer memory, one or more compact discs, floppy disks, compact discs, optical disks, magnetic tapes, flash memories, circuit configurations in field programmable gate arrays or other semiconductor devices, or other tangible computer storage medium) encoded with one or more programs that, when executed on one or more computers or other processors, perform methods that implement one or more of the various embodiments described above. The computer-readable medium or media can be transportable and may be non-transitory media.

When the embodiments are implemented in software, the software code can be executed on any suitable processor or collection of processors. A computer may be embodied in any of a number of forms, such as a rack-mounted computer, a desktop computer, a laptop computer, or a tablet computer, as non-limiting examples. Additionally, a computer may be embedded in a device not generally regarded as a computer but with suitable processing capabilities, including a personal digital assistant, a Smart phone or any other suitable portable or fixed electronic device.

Having thus described at least one illustrative embodiment of the disclosure, various alterations, modifications and improvements will readily occur to those skilled in the art. Such alterations, modifications, and improvements are intended to be part of this disclosure, and are intended to be within the spirit and the scope of the present disclosure. Accordingly, the foregoing description is by way of example only and is not intended to be limiting. The various inventive aspects are limited only as defined in the following claims and the equivalents thereto.

The invention claimed is:

1. A backplane for a display system, the display system having a plurality of display pixels, the backplane comprising:

a first circuitry configured to enable a first subset of pixels of the plurality of display pixels, wherein the enabling of the first subset of pixels determines that the first subset of pixels will undergo a transition;

a second circuitry configured to transition the enabled first subset of pixels to a first display state using voltage signals, wherein the voltage signals include a global drive signal, the global drive signal affecting only the enabled first subset of pixels; and a control circuit configured to control the first circuitry and the second circuitry to repeat the enabling and the transitioning for a second subset of pixels corresponding to a second display state.

2. The backplane of claim 1, wherein the voltage signals include a global drive signal affecting only the enabled first subset of pixels.

3. The backplane of claim 1, wherein the control circuit is configured to control the first circuitry and the second circuitry to repeat the enabling and the transitioning for a plurality of different subsets of pixels and corresponding display states.

4. The backplane of claim 1, wherein the first circuitry is configured to disable the pixels of the display system that are not enabled.

5. The backplane of claim 1, wherein the second circuit is configured to apply a global drive signal to the plurality of display pixels of the display system.

6. The backplane of claim 1, wherein the second circuitry is coupled in series with the first circuitry.

7. The backplane of claim 1, wherein the second circuit is configured to apply a global drive signal to all the plurality of display pixels of the display system simultaneously.

8. The backplane of claim 1, wherein the second circuit is configured to apply a global drive signal to the display system, wherein different global drive signals correspond to different display states.

9. The backplane of claim 1, wherein the control circuit is configured to control the first circuitry and the second circuitry to transition the plurality of display pixels of the display system to an initial display state before enabling the first subset of pixels.

10. The backplane of claim 1, wherein the control circuit is configured to control the first circuitry and the second circuitry to transition the enabled first subset of pixels to an initial display state and then to transition the enabled first subset of pixels from the initial display state to the first display state.

11. The backplane of claim 1, wherein the first circuitry includes a holding capacitor configured to store an enable voltage.

12. The backplane of claim 1, wherein the control circuit is configured to control the first circuitry to scan the plurality of display pixels of the display system.

13. The backplane of claim 1, wherein the first display state is a pixel color.

14. The backplane of claim 1, wherein the first display state is a gray level.

15. The backplane of claim 1, wherein the display system comprises an electrophoretic display device.

16. The backplane of claim 1, wherein the display system has two or more stable display states.

17. The backplane of claim 1, wherein the first circuitry includes a pixel circuit associated with each of the plurality of display pixels of the display system, each pixel circuit including:

a first transistor having a source, a gate and a drain and configured to receive a pixel enable voltage on the source and a select voltage on the gate;

a holding capacitor coupled between the drain of the first transistor and a reference voltage; and a second transistor having a source, a gate and a drain, the gate coupled to the drain of the first transistor, the source coupled to the pixel electrode of the associated pixel and the drain coupled to the reference voltage.

18. The backplane of claim 1, wherein the first circuitry includes a pixel circuit associated with each of the plurality of display pixels of the display system, each pixel circuit including:

a first transistor having a source, a gate and a drain and configured to receive a pixel enable voltage on the source and a select voltage on the gate;

a holding capacitor coupled between the drain of the first transistor and a reference voltage; and a second transistor having a source, a gate and a drain, the gate coupled to the drain of the first transistor, the source coupled to the pixel electrode of the associated pixel and the drain coupled to the drive circuit.

* * * * *